United States Patent [19]

Jenkins

[11] 3,960,269

[45] June 1, 1976

[54] COMBINATION ASH TRAY AND CHEWED GUM DISPOSAL PACKAGE

[76] Inventor: Garry W. Jenkins, 4218 Lewis St., P.O. Box 777, Oceanside, Calif. 92054

[22] Filed: Apr. 7, 1975

[21] Appl. No.: 565,817

[52] U.S. Cl. ..... 206/233

[51] Int. Cl.[2] ..... A45C 11/00; B65D 85/67

[58] Field of Search ..... 206/216, 233, 135, 133, 206/494; 220/20.5; 221/99, 102; 312/211, 212, 290

[56] References Cited

UNITED STATES PATENTS

| | | | |
|---|---|---|---|
| 1,087,147 | 2/1914 | Shonk | 206/135 |
| 1,590,202 | 6/1926 | Neahr | 206/135 |
| 2,007,042 | 7/1935 | Duckett | 206/233 |

*Primary Examiner*—William T. Dixson, Jr.

[57] ABSTRACT

A hollow receptacle has a relatively small hole through its wall to drop wrapped chewed gum into its interior and it has a relatively large hole in its top wall for the discharge of the wrapped gum, the large hole being normally closed by an ash tray which obscures the wrapped gum from view. An area is provided in the front of the interior for a supply of wrapping tissues which are to be withdrawn through a forward slot.

2 Claims, 6 Drawing Figures

COMBINATION ASH TRAY AND CHEWED GUM DISPOSAL PACKAGE

This invention relates to a combination package which serves the dual purpose of an ash tray and a receptacle to hold discarded, chewed, chewing gum. More particularly, the combination package provides a supply of tissues in which chewed gum is to be wrapped and a receptacle in which the wrapped gum is to be conveniently dropped. To facilitate the periodic removal of this wrapped gum, there is a large hole in the top wall of the receptacle and as a feature of this invention this hole is normally closed by the ash tray.

Figure 1:
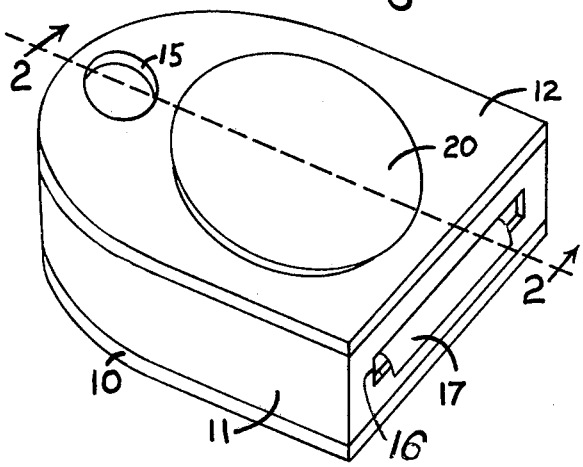
Figure 3:
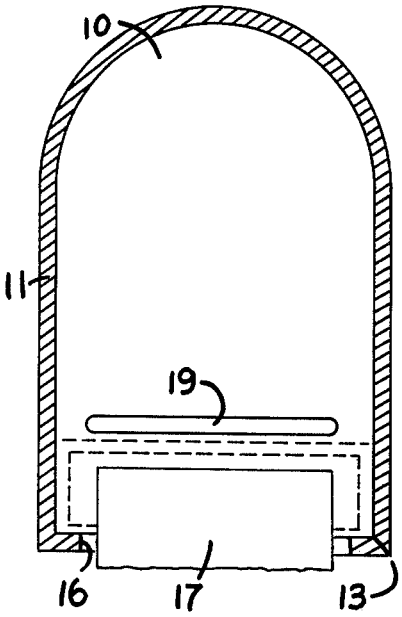
Figure 2:
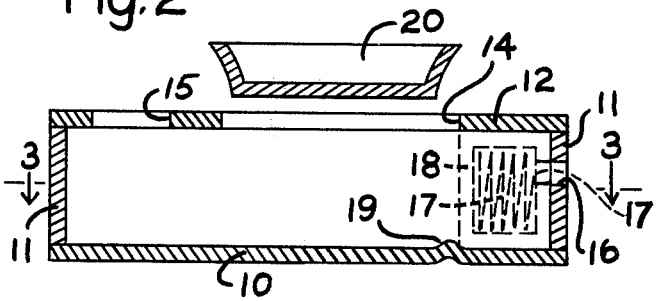
Figure 6:
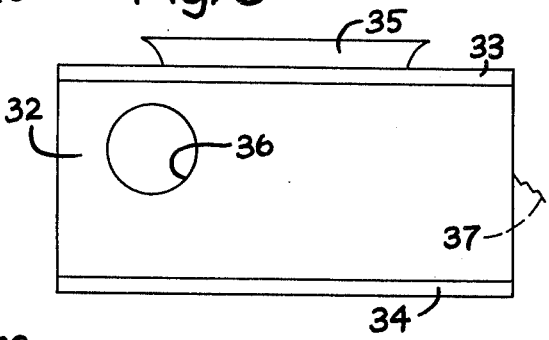
Figure 4:
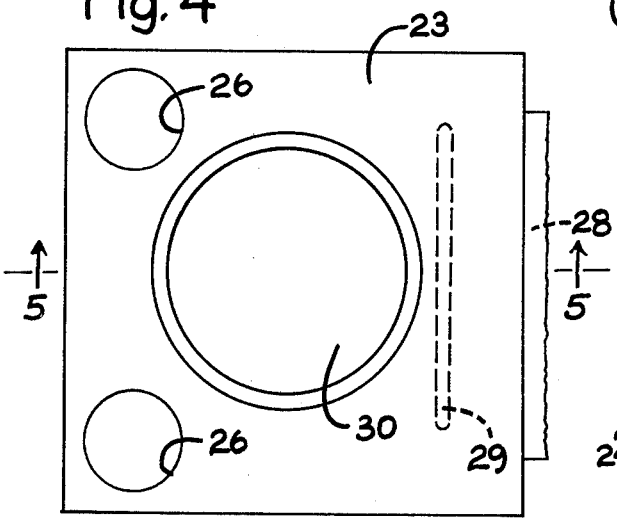
Figure 5:
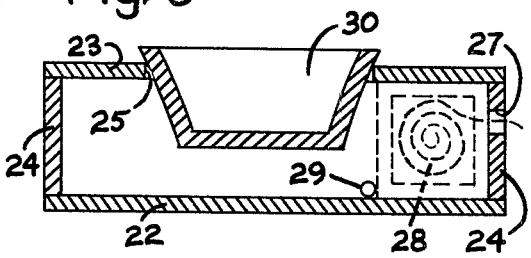

This combination package is ideally suited for use in restaurants, clubs and meeting rooms, for instance, as persons attending such places frequently chew gum and/or smoke cigarettes and other tobacco products. Ash trays are commonly provided at such places but there are no means to supply tissues in which chewed gus is to be wrapped and discarded out of sight. An important feature of this invention is that a combination package is so structured that it occupies about the same space as the ordinary ash tray but serves both as an ash tray, a receptacle for chewed gum and a source of supply of wrapping tissues to enclose the chewed, sticky gum. Representative examples of the invention are illustrated in the accompanying drawings, in which:

FIG. 1 is a perspective view of one embodiment of the invention from a frontward viewpoint, FIG. 2 is a sectional view in elevation on the line 2—2 of FIG. 1 with the ash tray displaced above the receptacle, FIG. 3 is a sectional plan view on the line 3—3 of FIG. 2, FIG. 4 is a plan view of a variation or modification of the invention, FIG. 5 is a sectional view on the line 5—5 of FIG. 4 and FIG. 6 is a side elevational view of another modification of the invention.

Referring first to FIGS. 1, 2 and 3, the receptacle is made up of a horizontal bottom plate 10, a vertical side wall 11 and a top horizontal plate 12. The bottom plate 10 and top plate 12 have the same shape in that they are square at their front ends and are curved, preferably semicircularly, at their rear ends. This peripheral formation is considered desirable because of its attractive appearance but it is not essential as the plates may be square or oblong as well.

The side wall 11 extends around the entire periphery of the bottom and top walls to thereby form a receptacle. The side wall may be made of a single strip or band of material which is bent to the appropriate shape to conform to the top and bottom walls. It is joined at its meeting edges to form the seam 13 shown in FIG. 3. Or, the side wall may be made up of several separate pieces which are joined to form the continuous wall.

The plates and side wall which form the receptacle may be made of sheet brass as it is strong and attractive and it can be easily soldered at the meeting edges. However, other metals such as stainless steel may be used as it may be spot welded to form the strong receptacle. Or, if desired, the receptacle may be made of plastic which is cemented together or is molded and shaped to size.

At the front, square end of the top plate 12 is a large hole 14 and at the rear curved end of this plate is a small hole 15. Both of these openings open downwardly into the interior of the receptacle. In the front portion of the side wall 11 is a lengthwise slot 16 for the removal of gum wrapping tissue 17 which is supplied from within the interior of the receptacle. This tissue may be conventional cigarette paper or paper which is similar to it.

A suitable form of tissue supply is shown in FIG. 2 in dotted lines as it forms no part of the invention since it may be a commercially supplied product. The separate tissues may be interleaved so that withdrawal of the projecting one will pull the next one partially out of the slot 16 so that it may be grasped. The interleaved tissues are stored in the carton 18 which snugly or frictionally fits in the front, squared portion of the receptacle. Since the pull on the tissues to withdraw them is always forward it will tend to maintain the carton 18 forward and in place. This carton can be inserted in place and be removed through the large opening 14.

To assure more positively that the carton 18 remains in place it may be pushed or snapped over the internal ridge 19 pressed upwardly from the bottom plate 10. There could be a similar internal ridge on the side and top walls but the intended frictional fit of the receptacle 18 and the ridge 19 should keep the tissue carton in place. The ridge 19 will not materially hinder placing the carton in place or removing it.

The ash tray 20 fits down in the large hole 14 and it preferably is of a size so that its top-most rim rests on the edge of the hole 14 so that the ash tray cannot fall in. By fitting down in the hole in this manner, the ash tray is quite stable but of course the hole 14 can be slightly smaller so that the ash tray comes to rest therein at a higher position. The ash tray should fit firmly so that it does not rock or tilt when it is being used.

A person who wishes to dispose of chewed gum, merely grabs the projecting tissue 17 and wraps the gum in it. This is then dropped through the small hole 15 and into the interior of the receptacle where it is out of sight. Because of the relatively large size of this receptacle it will hold a large number of wrapped pieces of gum. To empty the receptacle the ash tray 20 is removed, the receptacle is turned upside down and the gum wrappings are dropped out through the large hole 14.

The ash tray is used in the usual manner and as it rests in the large hole 14 it is not displaced, when it is used. It serves the important dual functions of being an ash tray and also a cover for the hole 14 so that the wrapped gum cannot be seen. The ash tray may be made of metal, heat resistant plastic or glass which should be opaque.

It should be observed that the large hole 14 is spaced sufficiently away from the front wall having the slot 16 therein so that there is room for the tissue carton 18. Mention may be made of the fact that one or both of the openings 14 and 15 may have shapes other than round; for instance they may be oval or square. The ash tray should have the same shape as the hole 14 it fits in to firmly hold it in place.

In the modification of FIGS. 4 and 5 the bottom plate 22 and the top plate 23 are rectangular in shape and this is to show that variations in the shape and dimensions of the receptacle are possible. As mentioned above, the side wall 24 may be shaped from one continuous strip which is attached at its meeting edges. If it simplifies manufacture each of the four sections of the side wall may be a separate piece and they may be attached at the four vertical corners. This form of construction may be found useful if it is desired that the front wall or any vertical wall slope forwardly or rearwardly.

The top plate 23 is shown as having a large hole 25 to receive the ash tray 30 and two holes or openings 26 to receive the wrapped chewed gum. The location of the holes 26 presents an attractive, symmetrical appearance. As is mentioned above, these holes may be square or may have some other shape.

The slot 27 for the tissue paper is made in the front wall and in this instance the tissue is shown as being supplied from a roll 28. It should be perforated so that it can more easily be torn off in separate pieces. The supply carton which holds the roll of tissue may frictionally fit in the front end of the interior of the receptacle as mentioned for the carton 18 above. Or, the carton can better be held in place by a crosswise rod 29 which is soldered or otherwise fastened to the top surface of the bottom plate 22. Of course, the upwardly formed ridge 19 may be provided for the carton to snap over and be retained against rearward displacement. As the carton will generally be of cardboard it will readily distort slightly enough for it to move over the rod 29. The carton protects the fresh tissues from the wrapped gum in the rear of the receptacle.

In the modification of FIG. 6 the side wall 32 is considerably higher than the corresponding wall 24 in FIG. 5. The side wall 32 is fastened to the top plate 33 and to the bottom plate 34 to form the receptacle. There is a large hole (not shown) in this top plate to receive the ash tray 35.

Through the side wall 32 is formed one or more holes 36 through which the wrapped, chewed gum is to be deposited. These side holes 36 should be close to the top plate 33 so that the wrapped gum will drop to the bottom of the receptacle and cannot fall back out of the holes 36. Holes in the top plate 33 may or may not be additionally povided.

What is claimed is:

1. A combination ash tray and chewed gum disposal package which comprises a receptacle defined by a bottom plate, a top plate and a peripheral side wall, said top plate having a relatively small opening therethrough to receive wrapped gum to be deposited in the receptacle, said top plate also having a relatively large opening therethrough for discharging wrapped gum from the receptacle interior, and a removable ash tray fitting in said large opening to serve as a closure and shield the wrapped gum from view, said large opening being spaced from the front face of the side wall to provide an interior area at the front of the receptacle to receive a tissue supply, said front face having a slot therethrough for withdrawal of tissue.

2. The combination package of claim 1 in which an internal ridge is provided to retain a tissue supply in place.

* * * * *